US009940899B2

(12) United States Patent
Hama et al.

(10) Patent No.: US 9,940,899 B2
(45) Date of Patent: Apr. 10, 2018

(54) IMAGE PROCESSING APPARATUS, COLOR ADJUSTMENT SYSTEM, AND NON-TRANSITORY COMPUTER READABLE MEDIUM

(71) Applicant: FUJI XEROX CO., LTD., Minato-ku, Tokyo (JP)

(72) Inventors: Daigo Hama, Kanagawa (JP); Noriko Sakai, Kanagawa (JP); Toshihiro Iwafuchi, Kanagawa (JP); Kazuhiko Horikawa, Kanagawa (JP); Makoto Fujio, Kanagawa (JP); Chizuru Yamazaki, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 206 days.

(21) Appl. No.: 14/057,661

(22) Filed: Oct. 18, 2013

(65) Prior Publication Data

US 2014/0210851 A1 Jul. 31, 2014

(30) Foreign Application Priority Data

Jan. 31, 2013 (JP) ..... 2013-017929

(51) Int. Cl.
*G09G 5/02* (2006.01)
*G09G 5/06* (2006.01)

(52) U.S. Cl.
CPC ..... *G09G 5/06* (2013.01); *G09G 5/026* (2013.01); *G09G 2340/06* (2013.01); *G09G 2370/12* (2013.01)

(58) Field of Classification Search
None
See application file for complete search history.

(56) References Cited

U.S. PATENT DOCUMENTS

2003/0142110 A1* 7/2003 Murashita ..... H04N 1/6052 345/600
2004/0140982 A1* 7/2004 Pate ..... H04N 9/3182 345/600

(Continued)

FOREIGN PATENT DOCUMENTS

JP 2007-065192 A 3/2007

*Primary Examiner* — Zhengxi Liu
*Assistant Examiner* — Khoa Vu
(74) *Attorney, Agent, or Firm* — Sughrue Mion, PLLC

(57) ABSTRACT

An image processing apparatus includes an image information transmission unit, a color information acquisition unit, and a conversion relationship creation unit. The image information transmission unit transmits, to a display device, pieces of color-conversion image information representing images used for performing color conversion for the display device, in ascending order of lightness of the images in a predetermined color space. The color information acquisition unit acquires color information of each image that is displayed on the display device in accordance with a corresponding piece of color-conversion image information among the pieces of color-conversion image information that have been transmitted by the image information transmission unit. The conversion relationship creation unit creates, on the basis of the color information that has been acquired by the color information acquisition unit, a conversion relationship for a color of an image to be displayed on the display device.

13 Claims, 6 Drawing Sheets

(56) References Cited

U.S. PATENT DOCUMENTS

| | | | | |
|---|---|---|---|---|
| 2005/0264837 | A1* | 12/2005 | Shimada | 358/1.9 |
| 2007/0139439 | A1* | 6/2007 | Kim et al. | 345/604 |
| 2008/0175505 | A1* | 7/2008 | Kishimoto | 382/254 |
| 2011/0013241 | A1* | 1/2011 | Ohara | H04N 1/00023 358/518 |
| 2013/0135484 | A1* | 5/2013 | Satoh et al. | 348/207.2 |

* cited by examiner

IMAGE PROCESSING APPARATUS, COLOR ADJUSTMENT SYSTEM, AND NON-TRANSITORY COMPUTER READABLE MEDIUM

CROSS-REFERENCE TO RELATED APPLICATIONS

This application is based on and claims priority under 35 USC 119 from Japanese Patent Application No. 2013-017929 filed Jan. 31, 2013.

BACKGROUND

Technical Field

The present invention relates to an image processing apparatus, a color adjustment system, and a non-transitory computer readable medium.

SUMMARY

According to an aspect of the invention, there is provided an image processing apparatus including an image information transmission unit, a color information acquisition unit, and a conversion relationship creation unit. The image information transmission unit transmits, to a display device, pieces of color-conversion image information representing images used for performing color conversion for the display device, in ascending order of lightness of the images in a predetermined color space. The color information acquisition unit acquires color information of each image that is displayed on the display device in accordance with a corresponding piece of color-conversion image information among the pieces of color-conversion image information that have been transmitted by the image information transmission unit. The conversion relationship creation unit creates, on the basis of the color information that has been acquired by the color information acquisition unit, a conversion relationship for a color of an image to be displayed on the display device.

BRIEF DESCRIPTION OF THE DRAWINGS

An exemplary embodiment of the present invention will be described in detail based on the following figures, wherein.

DETAILED DESCRIPTION

Description of Overall Configuration of Image Display System

Referring to the accompanying drawings, an exemplary embodiment of the present invention will be described in detail below.

Figure 1:
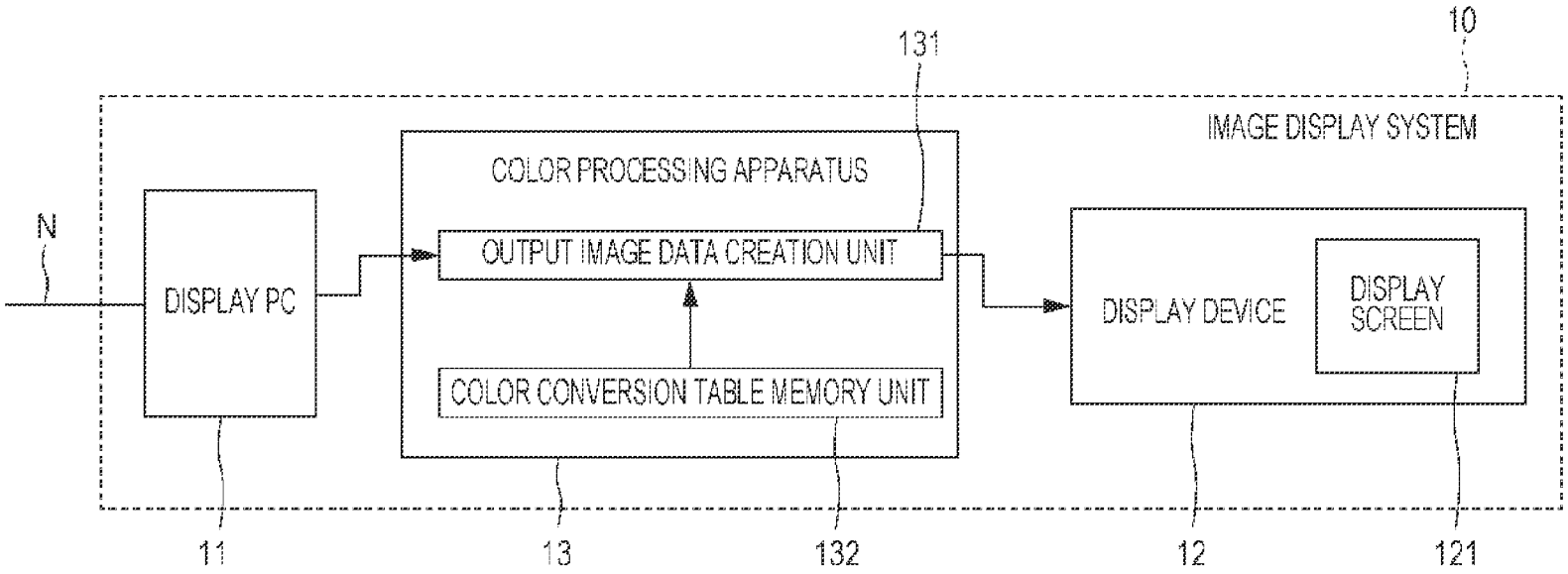
FIG. 1 illustrates an example of the configuration of an image display system according to an exemplary embodiment.

FIG. 1 illustrates an example of the configuration of an image display system 10 according to the exemplary embodiment.

This image display system 10 includes a personal computer for display (hereinafter, referred to as a display PC) 11, a display device 12, and a color processing apparatus 13. The display PC 11 is connected to a network N and performs processing, such as creation of image data for use in display (input image data or image information). The display device 12 displays an image on a display screen 121. The color processing apparatus 13, which is an example of a color conversion apparatus, performs color conversion processing on input image data fed from the display PC 11 by using a color conversion table (conversion relationship) and outputs the resulting image data (output image data for display) to the display device 12. The image display system 10 is connected to another image display system, various printers, or the like via the network N.

In this image display system 10, the display PC 11 and the color processing apparatus 13 are connected via Digital Visual Interface (DVI). The color processing apparatus 13 and the display device 12 are also connected via DVI. Note that the connection may be made via High-Definition Multimedia Interface (HDMI) or DisplayPort instead of DVI.

The display PC 11, which is an example of a supply apparatus, may be a general-purpose PC. The display PC 11 is configured to perform processing, such as creation of input image data, by running various kinds of application software under management of the operating system (OS).

The display device 12 may be a device (for example, a liquid crystal display for a PC, a liquid crystal television, or a projector) which has a function of displaying an image through an additive process. Accordingly, the display system employed by the display device 12 is not limited to the liquid crystal system. In the example illustrated in FIG. 1, the display screen 121 is included in the display device 12. However, for example, in the case where the display device 12 is a projector, the display screen 121 may be a screen provided outside the display device 12.

The color processing apparatus 13 includes an output image data creation unit 131, and a color conversion table memory unit 132 which is an example of a memory.

The output image data creation unit 131 performs color conversion on input image data fed from the display PC 11 by using a color conversion table read from the color conversion table memory unit 132, and outputs the resulting output image data for display to the display device 12.

The color conversion table memory unit 132 stores a color conversion table, which is used by the above-described output image data creation unit 131 to create output image data for display. Examples of the color conversion table include a conversion matrix and a one-dimensional or multi-dimensional lookup table (LUT). In this exemplary embodiment, a multi-dimensional LUT is used in order to perform color conversion more accurately. Note that the color conversion table memory unit 132 may be a nonvolatile memory (for example, a flash memory) which is readable and writable and is capable of holding the content stored therein without any supplied power.

FIG. 1 illustrates the image display system 10 in which one display device 12 is connected to one display PC 11 via one color processing apparatus 13, but the configuration is not limited to this one. For example, a multi-monitor configuration is also employable in which multiple display devices 12 are connected to one color processing apparatus 13 and different images which are continuous are displayed on the respective display devices 12.

In the image display system 10 according to this exemplary embodiment, it is not the display PC 11 but the color processing apparatus 13 that performs color conversion processing on input image data and creates output image data for display. A color conversion table used by the color processing apparatus 13 during the color conversion processing is created by taking into account, for example, device characteristics of the display device 12 and device characteristics of another image display system or printer connected via the network N, so as to make each color expressed by the image display system 10 illustrated in FIG. 1 and a corresponding color expressed by the other image display system or printer match. In the image display system 10, the color conversion table is created by taking into account the device characteristics of the display device 12 in a state in which a color setting system described below is externally connected to the image display system 10.

Now, a description will be given of the color setting system connected to the image display system 10 when the color conversion table used by the color processing apparatus 13 is created.

Figure 2:
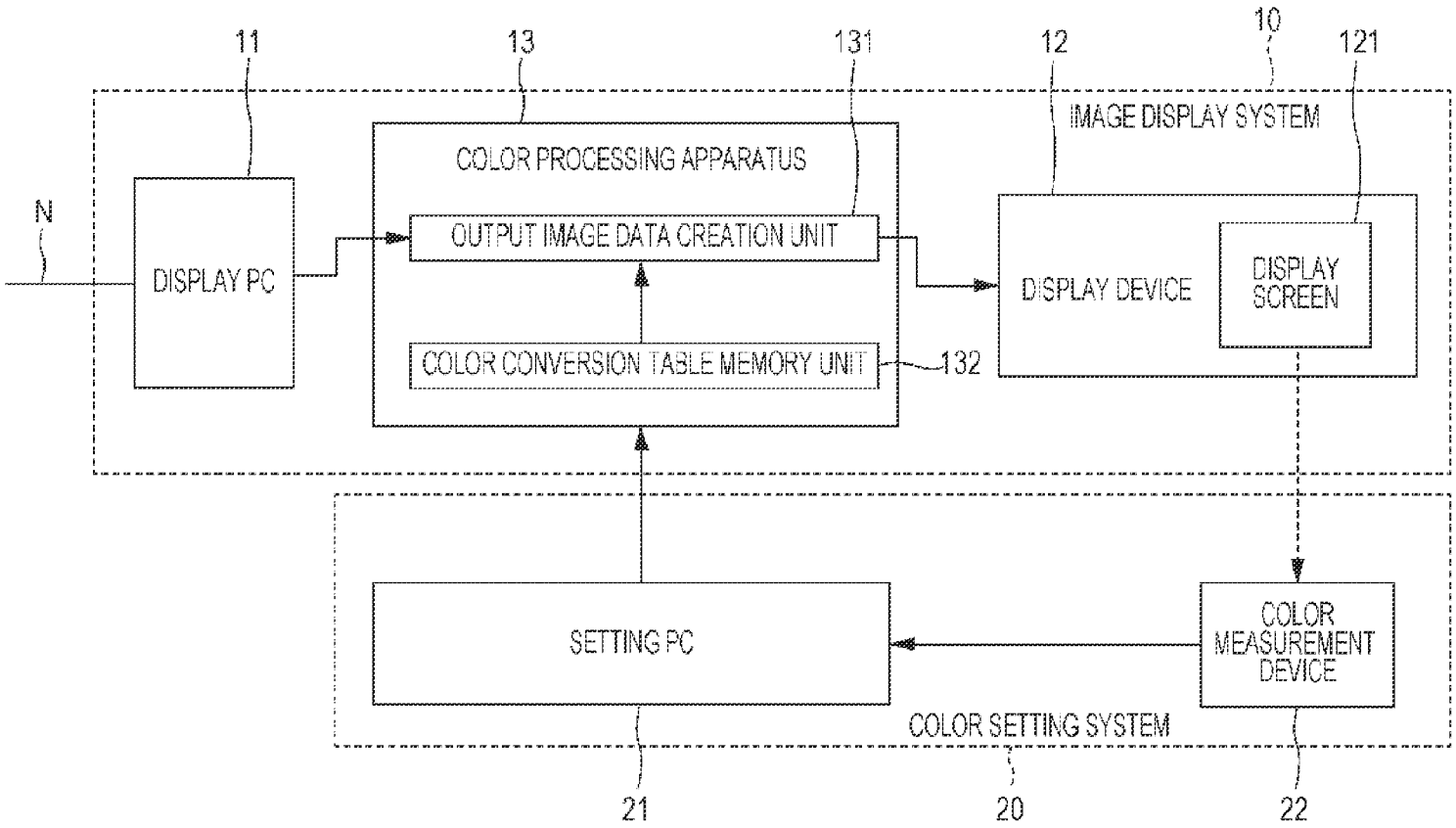
FIG. 2 illustrates a state in which a color setting system is connected to the image display system illustrated in FIG. 1.

FIG. 2 illustrates a state in which a color setting system 20 is connected to the image display system 10 illustrated in FIG. 1.

The color setting system 20 according to this exemplary embodiment includes a PC for setting (hereinafter, referred to as a setting PC) 21, and a color measurement device 22. The setting PC 21 is connected to the color processing apparatus 13 of the image display system 10. The color measurement device 22 is connected to the setting PC 21 and is configured to measure a color of an image displayed on the display screen 121 of the display device 12 of the image display system 10.

In this color setting system 20, the setting PC 21 and the color measurement device 22 are connected via Universal Serial Bus (USB) or an interface based on Recommended Standard 232 version C (RS-232C). Also, the setting PC 21 of the color setting system 20 and the color processing apparatus 13 of the image display system 10 are connected via USB.

Although details will be described later, the setting PC 21 of the color setting system 20 is a general-purpose PC and may be, for example, a notebook PC that is excellent in portability. The setting PC 21 runs various kinds of application software under management of the OS.

The color measurement device 22 includes a sensor configured to measure a color of an image displayed on the display screen 121. The sensor is disposed in contact with or in no contact with the display screen 121 of the display device 12 of the image display system 10. In this example, a measurement area of the sensor of the color measurement device 22 is set to be equal to or smaller than the display screen 121. The color measurement device 22 is configured to measure a color not at the entire area of the display screen 121 but at a predetermined portion of the entire area.

FIG. 2 illustrates the color setting system 20 in which one color measurement device 22 is connected to one setting PC 21, but the configuration is not limited to this one. For example, a configuration is also employable in which multiple color measurement devices 22 are connected to one setting PC 21.

In this exemplary embodiment, the setting PC 21 of the color setting system 20 is configured to create a color conversion table and write the color conversion table in the color conversion table memory unit 132 of the color processing apparatus 13 of the image display system 10. In this exemplary embodiment, this setting PC 21 may be considered as a conversion relationship creation apparatus (image processing apparatus) configured to create the color conversion table used by the color processing apparatus 13.

The image display system 10 according to this exemplary embodiment is usually disconnected from the color setting system 20. In this state, the image display system 10 displays an image (display image) based on output image data for display, which is obtained as a result of the color processing apparatus 13 performing color conversion on input image data created by the display PC 11, on the display screen 121 of the display device 12. On the other hand, when the color conversion table is created or modified, the color setting system 20 is connected to the image display system 10. In this state, the image display system 10 displays an image (image for color measurement or color patch) based on output image data for color measurement, which is created by the color processing apparatus 13, on the display screen 121 of the display device 12.

As described above, creation of a multi-dimensional LUT for use in color conversion processing performed for the display device 12 requires measurement of images for color measurement (hereinafter, referred to as color-measurement images) by using the color measurement device 22 in order to grasp device characteristics of the display device 12. This measurement requires calibration of the color measurement device 22. However, after a certain period (for example, approximately five to ten minutes) from the calibration of the color measurement device 22, the measurement accuracy drops significantly because of a change over time. Also, many (for example, 150 or more) color-measurement images subjected to measurement need to be prepared in order to increase the measurement accuracy. Further, typically, it requires approximately four seconds to obtain a stable measurement value for each color-measurement image. For these reasons, in the case where highly accurate measurement is desired, calibration needs to be regularly performed during the measurement, undesirably requiring a lot of time and work. There is a related art that improves the accuracy by correcting the measurement value. However, because so many color-measurement images are required in measurement in order to create parameters such as a multi-dimensional LUT for correcting multi-dimensional colors, high accuracy may not be achieved depending on the color. Moreover, because the configuration of the device gets complicated, a period required for processing undesirably increases.

Accordingly, in this exemplary embodiment, the setting PC 21 having the following configuration is used to cope with the above-described issues.

Example of Hardware Configuration of Setting PC

Now, the hardware configuration of the setting PC 21 will be described.

Figure 3:
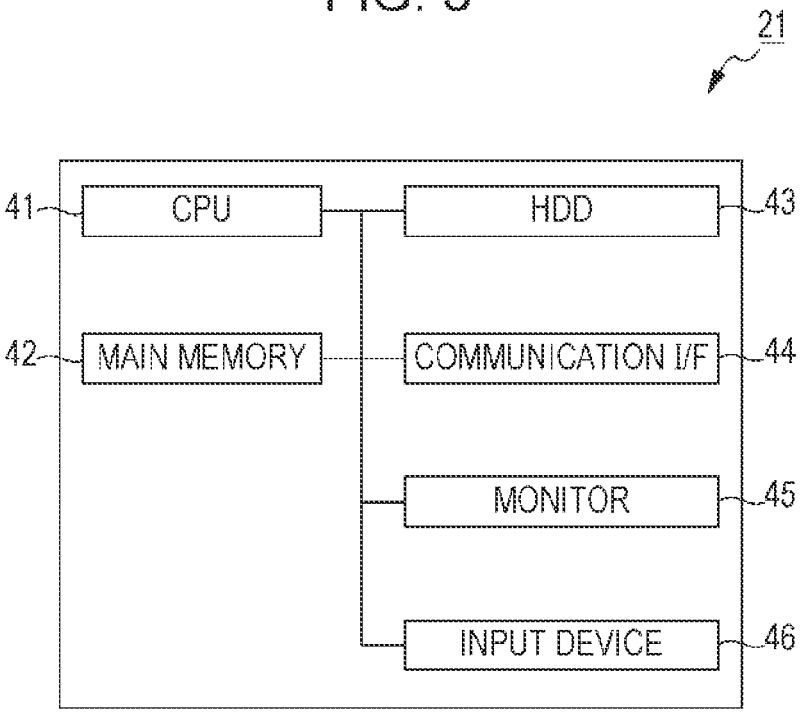
FIG. 3 illustrates the hardware configuration of a personal computer (PC) for setting.

FIG. 3 illustrates the hardware configuration of the setting PC 21.

As described above, the setting PC 21 is implemented by a PC or the like. The setting PC 21 includes a central processing unit (CPU) 41 which is a computation unit, a main memory 42 which is a memory, and a hard disk drive (HDD) 43 as illustrated in FIG. 3. The CPU 41 executes various programs, such as the OS and application software. The main memory 42 is a memory area configured to store various programs and data used during execution of the various programs, for example. The HDD 43 is a memory area configured to store input data and output data for various programs, for example.

The setting PC 21 also includes a communication interface (hereinafter, referred to as a communication I/F) 44 configured to perform communication with an external apparatus, a monitor 45 including a video memory and a display and configured to display an image, and an input device 46 including a keyboard and a mouse.

Example of Functional Configuration of Setting PC

Figure 4:
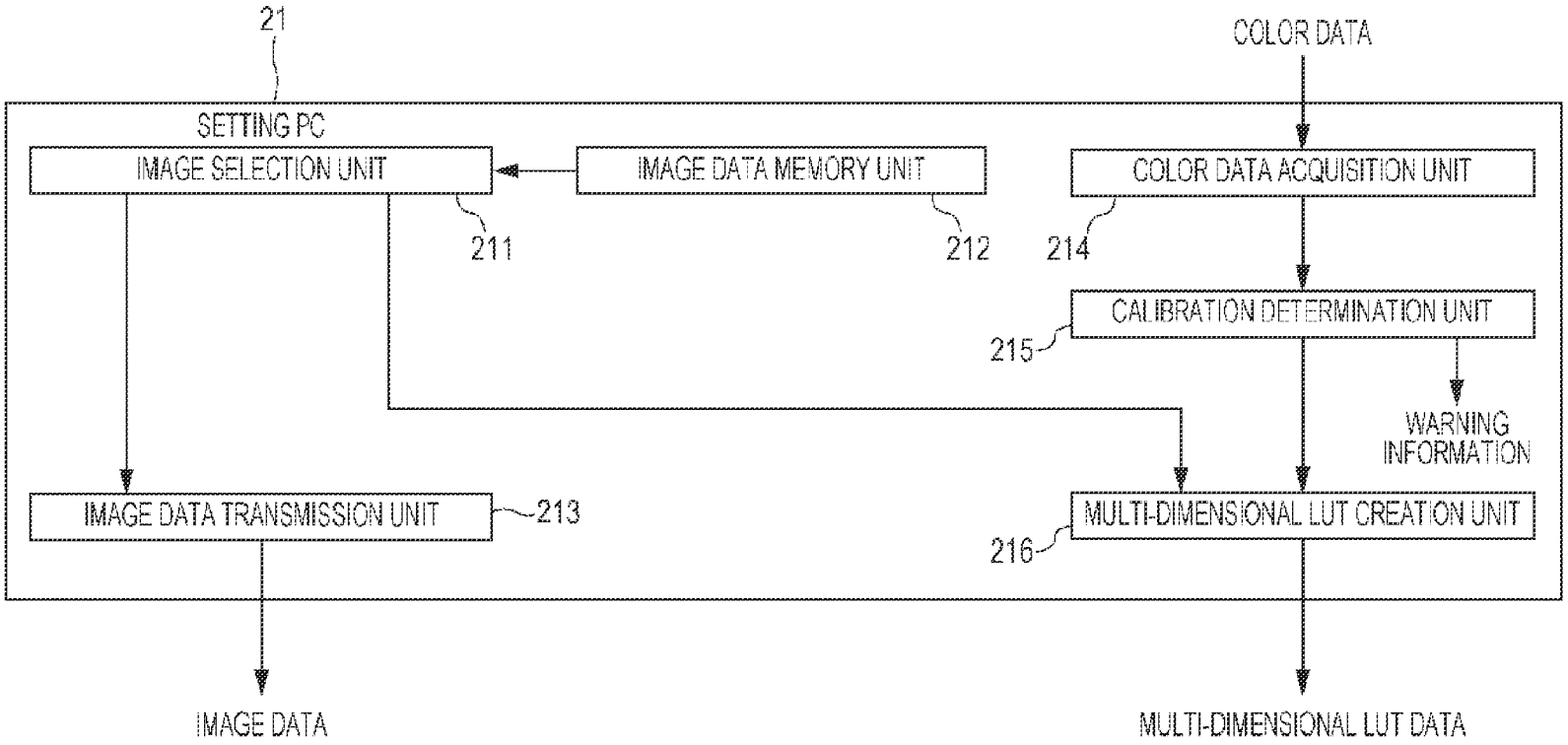
FIG. 4 illustrates an example of the functional configuration of the PC for setting of the exemplary embodiment.

FIG. 4 illustrates an example of the functional configuration of the setting PC 21 of the exemplary embodiment.

As illustrated in FIG. 4, the setting PC 21 includes an image selection unit 211, an image data memory unit 212, an image data transmission unit 213, a color data acquisition unit 214, a calibration determination unit 215, and a multi-dimensional LUT creation unit 216.

The image selection unit 211 selects an image used for performing color adjustment for the display device 12. This image used for performing color adjustment is a color-measurement image described above.

The image data memory unit 212 stores pieces of image data (information) of color-measurement images to be selected by the image selection unit 211. The image selection unit 211 acquires image data of a selected color-measurement image from the image data memory unit 212.

Herein, the image selection unit 211 selects multiple color-measurement images. At this time, the image selection unit 211 sequentially selects color-measurement images in accordance with rules (1) to (3) below.

(1) In ascending order of lightness of color-measurement images in a predetermined color space.

(2) In the case of color-measurement images having substantially equal lightnesses in the predetermined color space, in ascending order of chroma of the color-measurement images in the predetermined color space.

(3) In the case of color-measurement images having substantially equal lightnesses and chromas in the predetermined color space, in ascending order of lightness of the color-measurement images in a color space that is different from the predetermined color space.

In this exemplary embodiment, each of the predetermined color space to be used and the color space that is different from the predetermined color space may be, for example, a uniform color space, such as the Lab color space; a color space represented by brightness/lightness and hue/saturation/chroma, such as the HSL or YCbCr color space; or the XYZ color space.

In the case of color-measurement images having substantially equal lightnesses and chromas in the predetermined color space, it is preferable to select a color-measurement image having a hue neighboring that of a color-measurement image that has been selected immediately before. If the hues of two images are too far apart, it may take some time before the color of the displayed color-measurement image becomes stable depending on the display device 12. This phenomenon may be coped with by selecting color-measurement images having neighboring hues.

Figure 5A:
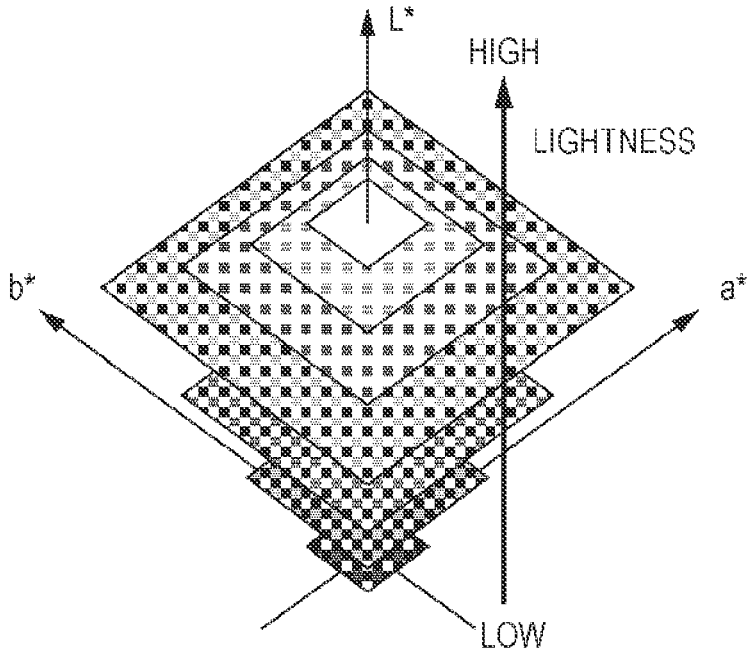
FIGS. 5A and 5B are conceptual diagrams illustrating an order in which an image selection unit selects images for color measurement.
Figure 5B:
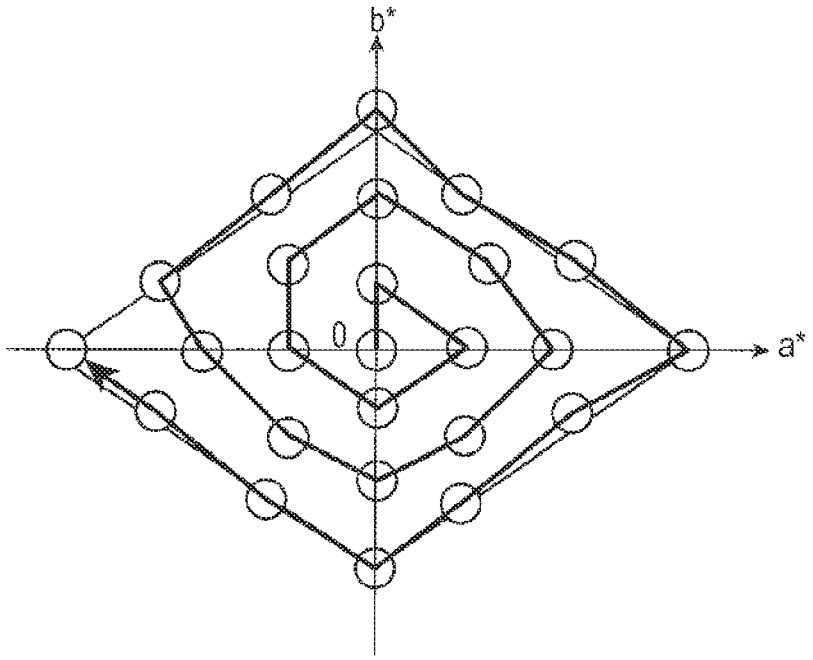

FIGS. 5A and 5B are conceptual diagrams illustrating an order in which the image selection unit 211 selects color-measurement images.

FIG. 5A illustrates the L*a*b* color space which serves as the predetermined color space. Color-measurement images are selected using the L*, a*, and b* values. In the illustrated L*a*b* color space, rhombuses sequentially arranged in the vertical direction represent respective color ranges selected as color-measurement images. In this case, the vertical direction corresponds to a lightness changing direction. The higher the position, the higher the lightness; the lower the position, the lower the lightness. Accordingly, color-measurement images are sequentially selected in such a manner that the color sequentially changes from the color located at the bottommost position to colors located at upper positions in this L*a*b* color space.

FIG. 5B illustrates the order in which color-measurement images having substantially equal lightnesses are selected. In this case, a color corresponding to the center where both the a* and b* values are 0 is first selected as a color having the lowest chroma. Then, colors having neighboring hues and higher chromas are sequentially selected as colors of the color-measurement images in ascending order of chroma.

The image data transmission unit 213, which is an example of an image information transmission unit, transmits pieces of image data of the color-measurement images that have been selected by the image selection unit 211 to the display device 12, in order to perform color adjustment for the display device 12. At this time, the image data transmission unit 213 transmits the pieces of image data of the color-measurement images to the display device 12 in an order in which the color-measurement images have been selected by the image selection unit 211.

Specifically, the image data transmission unit 213 transmits the pieces of image data of the color-measurement images in ascending order of lightness of the color-measurement images. In the case of color-measurement images having substantially equal lightnesses, the image data transmission unit 213 transmits the pieces of image data of the color-measurement images in ascending order of chroma of the color-measurement images. Further, in the case of color-measurement images having substantially equal lightnesses and chromas, the image data transmission unit 213 transmits the pieces of image data of the color-measurement images in ascending order of lightness of the color-measurement images in a color space that is different from the predetermined color space.

The image data transmission unit 213 may preferably insert image data of an image for accuracy checking (hereinafter, referred to as an accuracy-check image) between pieces of image data of color-measurement images and transmits the image data at predetermined time intervals. This image data may be, for example, image data for displaying the black screen. In accordance with this image data, a black image is displayed on the entire screen of the display device 12. The measurement accuracy of the color measurement device 22 may be checked on the basis of a difference between color data obtained by reading the color of the displayed black screen with the color measurement device 22 and the value that is supposed to be obtained. That is, a determination may be made as to whether the measurement accuracy of the color measurement device 22 has dropped because of lapse of time from the calibration.

The display device 12 sequentially displays color-measurement images in accordance with the pieces of image data of the color-measurement images that have been transmitted by the image data transmission unit 213. The color measurement device 22 reads the color of each color-measurement image displayed on the display device 12. The color measurement device 22 then transmits to the setting PC 21 color information (color data) obtained by reading each displayed color-measurement image. The color data output by the color measurement device 22 at this time may include, for example, the X, Y, and Z values in the XYZ color space or the L*, a*, and b* values in the L*a*b* color space.

The color data acquisition unit 214, which is an example of a color information acquisition unit, acquires pieces of color data of the respective color-measurement images from the color measurement device 22.

The calibration determination unit 215 determines whether the color measurement device 22 needs to be calibrated when acquiring the color data of the accuracy-check image as the color data of the color-measurement image from the color measurement device 22. Specifically, if a difference between the color data obtained by reading the color of the accuracy-check image with the color measurement device 22 and the value that is supposed to be obtained is greater than or equal to a predetermined amount, the calibration determination unit 215 determines that the color measurement device 22 needs to be calibrated. At this time, the calibration determination unit 215 displays warning information indicating the necessity of calibration on the display device 12, for example, so as to draw attention of an operator who operates the setting PC 21. If the data difference is smaller than the predetermined amount, the calibration determination unit 215 determines that the color measurement device 22 need not be calibrated.

The multi-dimensional LUT creation unit 216, which is an example of a conversion relationship creation unit, creates a multi-dimensional LUT (conversion relationship) for a color of an image to be displayed on the display device 12, on the basis of pieces of color data acquired by the color data acquisition unit 214.

This multi-dimensional LUT may be created using a known method, for example, a linear regression model, a high-order polynomial approximation model, or a neural model. This multi-dimensional LUT enables conversion from input image data represented by, for example, a red signal (R), a green signal (G), and a blue signal (B) into output image data represented by a red signal (R'), a green signal (G'), and a blue signal (B') (conversion from RGB into R'G'B').

The HDD 43 of the setting PC 21 illustrated in FIG. 3 stores programs that implement the functions illustrated in FIG. 4. These programs are loaded into the main memory 42 and the CPU 41 executes processes based on these programs, whereby these functions are implemented.

Specifically, in accordance with an instruction given by the CPU 41 on the basis of a program prepared, for example, as application software, the setting PC 21 transmits image data of a color-measurement image to the display device 12 via the communication I/F 44 or acquires color data of the color-measurement image from the color measurement device 22. Image data of each color-measurement image is stored in the HDD 43. In accordance with an instruction given by the CPU 41, images used for performing color adjustment for the display device 12 are selected and pieces of image data of the selected color-measurement images are acquired from the HDD 43. Further, the multi-dimensional LUT may be created as a result of the CPU 41 performing computation. Also, the warning information indicating the necessity of calibration may be displayed on the monitor 45. An instruction to start processing may be given to the setting PC 21 via the input device 46.

Description of Operation of Setting PC

Figure 6:
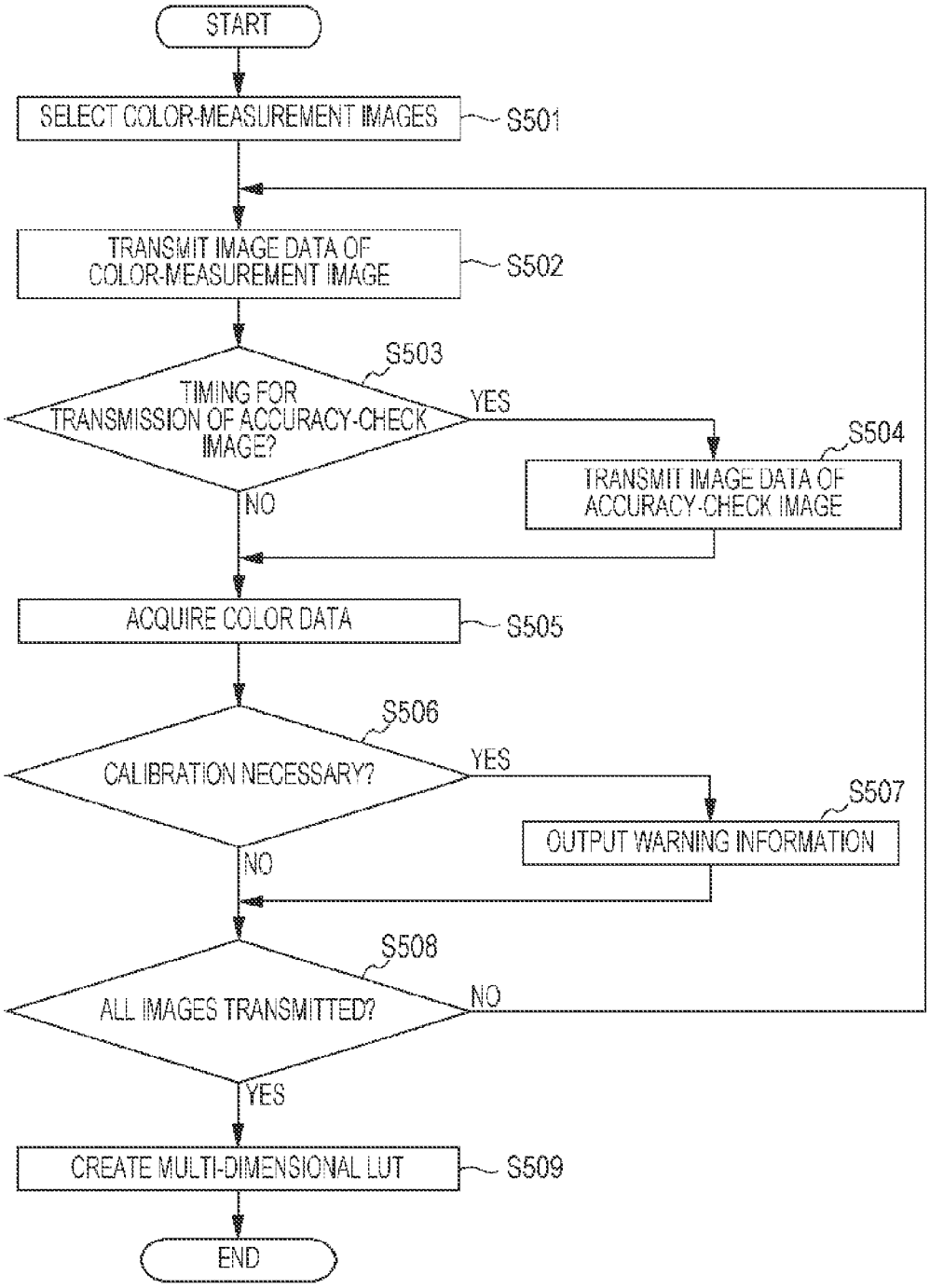
FIG. 6 is a flowchart describing an example of an operation performed by the PC for setting.

FIG. 6 is a flowchart describing an example of an operation performed by the setting PC 21.

An operation performed by the setting PC 21 will be described below using FIGS. 4 and 6.

First, the image selection unit 211 selects color-measurement images used for performing color adjustment for the display device 12, and acquires pieces of image data of these color-measurement images from the image data memory unit 212 (step S501). At this time, the image selection unit 211 sequentially selects the color-measurement images in accordance with the rules (1) to (3) described above.

Then, the image data transmission unit 213 transmits image data of one of the color-measurement images that have been selected by the image selection unit 211 to the display device 12 (step S502). Because the pieces of the color-measurement images are transmitted by the image data transmission unit 213 in an order in which the color-measurement images have been selected by the image selection unit 211, the pieces of image data are transmitted to the display device 12 one by one in the same order as that based on the rules (1) to (3) described above.

Then, the image data transmission unit 213 determines whether a timing at which the image data of the accuracy-check image is transmitted has come (step S503). As described above, this image data is image data for displaying the black screen on the display device 12. A determination as to whether the timing at which the image data of the accuracy-check image is transmitted has come may be made in accordance with whether a predetermined period or more has passed from the start of measurement or the previous transmission of this image data.

If determining that the timing at which the image data of the accuracy-check image is transmitted has come (YES in step S503), the image data transmission unit 213 transmits this image data (step S504). In contrast, if the image data transmission unit 213 determines that the timing at which the image data of the accuracy-check image is transmitted has not come yet (NO in step S503), the process proceeds to step S505.

Then, the color data acquisition unit 214 acquires color data of the color-measurement image from the color measurement device 22 (step S505).

If the color data acquisition unit 214 acquires color data of the accuracy-check image as the color data of the color-measurement image, the calibration determination unit 215 determines whether the color measurement device 22 needs to be calibrated (step S506). If determining that the color measurement device 22 needs to be calibrated (YES in step S506), the calibration determination unit 215 outputs the warning information to the monitor 45 (step S507). At this time, the processing may be paused until calibration of the color measurement device 22 ends. If the calibration determination unit 215 determines that the color measurement device 22 need not be calibrated (NO in step S506), the process proceeds to step S508.

Then, the image data transmission unit 213 determines whether all the pieces of image data of the color-measurement images that have been selected by the image selection unit 211 have been transmitted to the display device 12 (step S508). If the image data transmission unit 213 has transmitted all the pieces of image data of the color-measurement images to the display device 12 (YES in step S508), the process proceeds to step S509. In contrast, if the image data transmission unit 213 has not transmitted all the pieces of image data of the color-measurement images to the display device 12 (NO in step S508), the process returns to step S502 in which image data of the next color-measurement image is transmitted to the display device 12.

Then, the multi-dimensional LUT creation unit 216 creates a multi-dimensional LUT used for adjusting a color of an image to be displayed on the display device 12, on the basis of the pieces of image data of the color-measurement images and the acquired pieces of color data (step S509).

Data of the created multi-dimensional LUT is stored as corresponding grid point data of the multi-dimensional LUT, which is a color conversion table stored in the color conversion table memory unit 132 (see FIG. 1) of the color processing apparatus 13.

As described above, in this exemplary embodiment, color-measurement images are measured in ascending order of lightness of the color-measurement images. This allows images having relatively low lightnesses to be measured when the measurement accuracy of the color measurement device 22 is high. Specifically, in the case of images having relatively low lightnesses are measured when the measurement accuracy of the color measurement device 22 is low, the influence of measurement errors is large. However, images having relatively high lightnesses are less likely to be influenced by the measurement errors. More specifically, for example, in the case where color data which is the measurement value output by the color measurement device 22 is represented by the X, Y, and Z values of the XYZ color space, all the X, Y, and Z values of an image having a relatively low lightness are small. If the measurement errors of the color measurement device 22 occur in this state, a ratio of the measurement errors to the measurement value is large, and consequently the influence of the measurement errors becomes large. In contrast, the X, Y, and Z values of an image having a relatively high lightness are relatively large. Thus, even if the measurement errors of the color measurement device 22 occur, the ratio of the measurement errors to the measurement value is small, and consequently the influence of the measurement errors becomes small. As a result, in this exemplary embodiment, the influence of measurement accuracy of the color measurement device 22 is reduced and accuracy of data of the ultimately created multi-dimensional LUT increases.

Also, in this exemplary embodiment, in the case of color-measurement images having substantially equal lightnesses, the color-measurement images are measured in ascending order of chroma because of a reason similar to that for lightness. Specifically, for example, in the case where color data which is the measurement value output by the color measurement device 22 is represented by the X, Y, and Z values of the XYZ color space, both the X and Z values of an image having a relatively low chroma are small. In contrast, the X and Z values of an image having a relatively high chroma are relatively large. Accordingly, if the measurement errors of the color measurement device 22 occur, images having relatively low chromas are more greatly affected by the measurement errors than images having relatively high chromas.

Further, in this exemplary embodiment, in the case of color-measurement images having substantially equal lightnesses and chromas in the predetermined color space, the color-measurement images are measured in ascending order of lightness of the color-measurement images in a color space that is different from this predetermined color space, because of the similar reason.

In this exemplary embodiment, images which require higher measurement accuracy are measured first. Accordingly, the frequency of calibration may be reduced, and consequently work required for the measurement may be reduced.

In the image display system 10 according to this exemplary embodiment, the color processing apparatus 13 is provided between the display PC 11 and the display device 12 separately from the display PC 11 and the display device 12. However, the configuration is not limited to this one. For example, the functions of the color processing apparatus 13 may be included in the display PC 11 or the display device 12.

Also, in this exemplary embodiment, the setting PC 21 and the display PC 11 are provided as separate devices. However, the display PC 11 may include the functions of the setting PC 21. In this case, the display PC 11 functions as an image processing apparatus (conversion relationship creation apparatus).

Description about Color Adjustment System

The color processing apparatus 13 and the setting PC 21 described above may be considered as a color adjustment system including the color processing apparatus 13 that performs, using a predetermined conversion table, color conversion processing on input image data created for displaying an image on the display device 12 and that outputs resulting image data to the display device 12; and the setting PC 21 that creates the color conversion table used by the color processing apparatus 13. The setting PC 21 includes the image data transmission unit 213 that transmits, to the display device 12, pieces of image data representing color-measurement images in ascending order of lightness of the images in a predetermined color space; the color data acquisition unit 214 that acquires color data of each image that is displayed on the display device 12 in accordance with a corresponding piece of image data among the pieces of image data of the color-measurement images that have been transmitted by the image data transmission unit 213; and the multi-dimensional LUT creation unit 216 that creates, on the basis of the color data that has been acquired by the color data acquisition unit 214, a color conversion table.

Description about Program

As described above, the processing performed by the setting PC 21 in this exemplary embodiment described above may be prepared as a program such as application software, for example.

Therefore, the processing performed by the setting PC 21 may be considered as a program that implements a function of transmitting, to the display device 12, pieces of image data representing color-measurement images in ascending order of lightness of the images in a predetermined color space, a function of acquiring color data of each image that is displayed on the display device 12 in accordance with a corresponding piece of image data among the pieces of image data of color-measurement images that have been transmitted, and a function of creating, on the basis of the color information that has been acquired, a color conversion table for a color of an image to be displayed on the display device 12.

Note that the program that implements this exemplary embodiment may be provided via a communication unit or after being stored on a recording medium, such as Compact Disc-Read Only Memory (CD-ROM).

While the exemplary embodiment has been described above, the technical scope of the present invention is not limited to the scope described in the exemplary embodiment described above. It is obvious from the description of claims that various modifications and improvements of the exemplary embodiment are also included in the technical scope of the present invention.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image processing apparatus comprising:

a processor configured to execute:

an image information transmission unit that transmits, to a display device, pieces of color-conversion image information representing images used for performing color conversion for the display device, in ascending order of lightness of the images in a predetermined color space;

a color information acquisition unit that acquires color information of each image that is displayed on the display device in accordance with a corresponding piece of color-conversion image information among the pieces of color-conversion image information that have been transmitted by the image information transmission unit;

a conversion relationship creation unit that creates, on the basis of the color information that has been acquired by the color information acquisition unit, a conversion relationship for a color of an image to be displayed on the display device; and a calibration determination unit configured to determine if a color measurement device is required to be calibrated one by one after each piece of color-conversion image information of each image is respectively acquired by the acquisition unit in ascending order of lightness, wherein the calibration determination unit determines if the color measurement device is required to be calibrated by determining whether a predetermined time interval has expired, in a case in which the calibration determination unit determines that the predetermined time interval has expired, the image information transmission unit pauses transmission of the pieces of color-conversion image information to the display device and further transmits an accuracy-check image to the display device, the accuracy-check image configured to cause the display device to display a black screen over an entire display of the display device, the color measurement device is configured to calibrate to the black screen, in a case in which the measurement device calibrates to the black screen, the image information transmission unit resumes transmission of the pieces of color conversion image information, and the pieces of the color-conversion image information are selected prior to the calibration determination unit determining if the color measurement device is required to be calibrated.

2. The image processing apparatus according to claim 1, wherein in a case where the images represented by the pieces of color-conversion image information have equal lightnesses in the predetermined color space, the image information transmission unit transmits the pieces of color-conversion image information in ascending order of chroma of the images.

3. The image processing apparatus according to claim 2, wherein in a case where the images represented by the pieces of color-conversion image information have equal lightnesses and chromas in the predetermined color space, the image information transmission unit transmits the pieces of color-conversion image information in ascending order of lightness of the images in a color space that is different from the predetermined color space.

4. The image processing apparatus according to claim 3, wherein the image information transmission unit inserts, between the pieces of color-conversion image information, accuracy-check image information representing an image used for accuracy checking, and transmits the pieces of color-conversion image information and the inserted accuracy-check image information.

5. The image processing apparatus according to claim 2, wherein the image information transmission unit inserts, between the pieces of color-conversion image information, accuracy-check image information representing an image used for accuracy checking, and transmits the pieces of color-conversion image information and the inserted accuracy-check image information.

6. The image processing apparatus according to claim 1, wherein in a case where the images represented by the pieces of color-conversion image information have equal lightnesses and chromas in the predetermined color space, the image information transmission unit transmits the pieces of color-conversion image information in ascending order of lightness of the images in a color space that is different from the predetermined color space.

7. The image processing apparatus according to claim 6, wherein the image information transmission unit inserts, between the pieces of color-conversion image information, accuracy-check image information representing an image used for accuracy checking, and transmits the pieces of color-conversion image information and the inserted accuracy-check image information.

8. The image processing apparatus according to claim 1, wherein the image information transmission unit inserts, between the pieces of color-conversion image information, accuracy-check image information representing an image used for accuracy checking, and transmits the pieces of color-conversion image information and the inserted accuracy-check image information.

9. The image processing apparatus according to claim 1, wherein the calibration determination unit is further configured to, after the transmitting by the image information transmission unit and prior to the acquiring by the acquisition unit at least one of the pieces of color-conversion image information, transmit to the display device an accuracy-check image, the color information acquisition unit is further configured to acquire the accuracy-check image, and the calibration determination unit is further configured to determine if the image processing apparatus is configured to be calibrated according to a comparison of the accuracy-check image acquired by the color information acquisition unit and the accuracy-check image transmitted by the calibration determination unit to the display.

10. The image processing apparatus according to claim 9, wherein the calibration determination unit is further configured to output to the display device, after acquiring at least one of the pieces of color-conversion image information by the acquisition unit, a warning display in response to a determination that the image processing apparatus is required to be calibrated according to the comparison.

11. The image processing apparatus according to claim 1, wherein the color information acquisition unit acquires the color information from the color measurement device, and the color measurement device is configured to measure the color information from a display of at least one of the pieces of color-conversion image information displayed by the display device.

12. A color adjustment system comprising:

a color conversion apparatus that performs, using a predetermined conversion relationship, color conversion processing on image information used for displaying an image on a display device and that outputs resulting image information to the display device; and a conversion relationship creation apparatus that creates the conversion relationship used by the color conversion apparatus, the conversion relationship creation apparatus including:

a processor configured to execute:

an image information transmission unit that transmits, to the display device, pieces of color-conversion image information representing images used for performing color conversion for the display device, in ascending order of lightness of the images in a predetermined color space, a color information acquisition unit that acquires color information of each image that is displayed on the display device in accordance with a corresponding piece of color-conversion image information among the pieces of color-conversion image information that have been transmitted by the image information transmission unit, a conversion relationship creation unit that creates, on the basis of the color information that has been acquired by the color information acquisition unit, the conversion relationship; and a calibration determination unit configured to determine if a color measurement device is required to be calibrated one by one after each piece of color-conversion image information of each image is respectively acquired by the acquisition unit in ascending order of lightness, wherein the calibration determination unit determines if the color measurement device is required to be calibrated by determining whether a predetermined time interval has expired, in a case in which the calibration determination unit determines that the predetermined time interval has expired, the image information transmission unit pauses transmission of the pieces of color-conversion image information to the display device and further transmits an accuracy-check image to the display device, the accuracy-check image configured to cause the display device to display a black screen over an entire display of the display device, the color measurement device is configured to calibrate to the black screen, in a case in which the measurement device calibrates to the black screen, the image information transmission unit resumes transmission of the pieces of color conversion image information, and the pieces of the color-conversion image information are selected prior to the calibration determination unit determining if the color measurement device is required to be calibrated.

13. A non-transitory computer readable medium storing a program causing a computer to execute a process, the process comprising:

transmitting, to a display device, pieces of color-conversion image information representing images used for performing color conversion for the display device, in ascending order of lightness of the images in a predetermined color space;

acquiring color information of each image that is displayed on the display device in accordance with a corresponding piece of color-conversion image information among the pieces of color-conversion image information that have been transmitted;

creating, on the basis of the color information that has been acquired, a conversion relationship for a color of an image to be displayed on the display device; and determining if a color measurement device is required to be calibrated one by one after each piece of color-conversion image information of each image is respectively acquired in ascending order of lightness;

determining if the color measurement device is required to be calibrated by determining whether a predetermined time interval has expired, in a case in which it is determined that the predetermined time interval has expired, pausing transmission of the pieces of color-conversion image information to the display device and further transmitting an accuracy-check image to the display device, the accuracy-check image configured to cause the display device to display a black screen over an entire display of the display device, the color measurement device is configured to calibrate to the black screen, in a case in which the measurement device calibrates to the black screen, the image information transmission unit resumes transmission of the pieces of color conversion image information, and the pieces of the color-conversion image information are selected prior to determining if the color measurement device is required to be calibrated.

* * * * *